US012478156B2

(12) United States Patent
Zhang

(10) Patent No.: US 12,478,156 B2
(45) Date of Patent: Nov. 25, 2025

(54) CARD HOLDER

(71) Applicant: Shenzhen Jiangda Hardware Products Co., Ltd., Shenzhen (CN)

(72) Inventor: Lijun Zhang, Shenzhen (CN)

(73) Assignee: SHENZHEN JIANGDA HARDWARE PRODUCTS CO., LTD., Shenzhen (CN)

( * ) Notice: Subject to any disclaimer, the term of this patent is extended or adjusted under 35 U.S.C. 154(b) by 0 days.

(21) Appl. No.: 18/818,642

(22) Filed: Aug. 29, 2024

(65) Prior Publication Data

US 2024/0415253 A1 Dec. 19, 2024

Related U.S. Application Data

(63) Continuation-in-part of application No. PCT/CN2024/075558, filed on Feb. 2, 2024.

(30) Foreign Application Priority Data

| | | |
|---|---|---|
| Feb. 15, 2023 | (CN) | 202320222422.8 |
| Mar. 10, 2023 | (CN) | 202320524177.6 |
| Dec. 26, 2023 | (CN) | 202323579288.6 |

(51) Int. Cl.
*A45C 11/18* (2006.01)

(52) U.S. Cl.
CPC ..... *A45C 11/182* (2013.01)

(58) Field of Classification Search
CPC ..... A45C 11/182; A45C 13/10; B42F 17/18
See application file for complete search history.

(56) References Cited

U.S. PATENT DOCUMENTS

| | | | | |
|---|---|---|---|---|
| 11,284,689 | B1 | 3/2022 | Duncan | |
| 11,793,283 | B1 | 10/2023 | Zhang | |
| 2013/0276943 | A1* | 10/2013 | Minn | A45C 1/06 150/137 |
| 2015/0083289 | A1* | 3/2015 | Johnson | A45C 1/06 150/144 |
| 2016/0324283 | A1* | 11/2016 | Kane | A45C 11/182 |
| 2017/0035169 | A1* | 2/2017 | Haarburger | A45C 1/06 |

FOREIGN PATENT DOCUMENTS

| | | |
|---|---|---|
| CN | 201777011 U | 3/2011 |
| CN | 216135331 U | 3/2022 |

* cited by examiner

*Primary Examiner* — Don M Anderson
*Assistant Examiner* — Justin Caudill
(74) *Attorney, Agent, or Firm* — Frank Niranjan

(57) ABSTRACT

The present invention provides a card holder including a card holder body. The card holder body includes a first and second card clamping plates; at least one connecting device is arranged between the first and second card clamping plates, and the first and second card clamping plates are connected through the at least one connecting device. Each connecting device includes two hinged connecting pieces. The connecting pieces are closed and opened to produce a relative displacement between the first and second card clamping plates, thus forming an internal variable space to accommodate a plurality of cards; the card holder body further includes an elastic piece arranged on the card holder body, and the elastic piece provides an elastic restoring force through which the first card clamping plate and the second card clamping plate can be restored from an open position to an initial position.

18 Claims, 10 Drawing Sheets

CARD HOLDER

FIELD OF THE INVENTION

The present invention relates to the technical field of card holders, and specifically relates to a card holder which is simple in structure and convenient to carry.

BACKGROUND OF THE INVENTION

With the long-term accumulation of metal card holders in the market, the requirements of users for product details are increasing. With the popularity of online payments, people are carrying less and less cash, and there is no longer a need for the function of carrying a large amount of cash, so the metal card holders not only need to accommodate cards, but also need the function of accommodating a small amount of cash and bills. The volume of wallets and the card holders also tends to be small and portable, and so on. The metal card holders in existing technology are used for accommodating bank cards, business cards, bills, and other cards.

In modern life, people have to deal with cards to some extent, such as various bank cards, supermarket cards, shopping cards, membership cards, etc. If many cards are not properly accommodated, it often brings unnecessary trouble. The card holders are precisely designed to manage so many cards, and can be said to be a product of modern economy. There are generally two forms of card holders, one is a flipping form, just like book pages; and another is a rotary form. In terms of materials, leather is the most common, just like the wallet, suitable for carrying around.

When there are too many cards in the card holder, it is not very convenient to place and take out the cards. In addition, when the card holder is carried, the cards may easily fall out of the card holder due to bumps on the road, causing unnecessary trouble.

SUMMARY OF THE INVENTION

An objective of the present invention is to provide a novel card holder which is simple and convenient to carry to solve the technical problems. By means of connecting devices, elastic displacement is implemented between a first card holder plate and a second card holder plate, an internal space can freely stretch out and draw back, thus a space for accommodating cards is formed, and the cards are clamped; and moreover, the function of accommodating the cards of different sizes is achieved.

The technical problem of the present invention is solved through the following technical solution: a card holder includes a card holder body; the card holder body includes a first card clamping plate and a second card clamping plate; at least one connecting device is arranged between the first card clamping plate and the second card clamping plate, and the first card clamping plate and the second card clamping plate are connected through the at least one connecting device; each connecting device includes two connecting pieces which are directly or indirectly hinged; the connecting pieces are opened so that the first card clamping plate and the second card clamping plate move relatively, thus forming an internal variable space being able to stretch out and draw back freely to thereby accommodate a plurality of cards; the card holder body further includes elastic pieces arranged on the card holder body, and the elastic pieces provide an elastic restoring force to the first card clamping plate and the second card clamping plate to restore from an open position to an initial position; and the elastic pieces have the elastic restoring force at the initial position so that the first card clamping plate and the second card clamping plate can be mutually clamped and the connecting pieces can be mutually folded.

Preferably, two connecting devices are arranged on each side of the opposite sides of the first card clamping plate and the second card clamping plate; and the two connecting pieces of each connecting device are indirectly hinged through at least one hinge piece.

Preferably, the elastic pieces are arranged between two hinge pieces; and the elastic pieces are springs or elastic strips or elastic ropes.

Preferably, the elastic pieces are positioned between the first card clamping plate and the second card clamping plate. Preferably, the elastic pieces are elastic straps or elastic strips.

Preferably, each connecting device further comprises another elastic piece being sleeved the corresponding connecting piece; one end of the another elastic piece is arranged in a mounting groove of the first card clamping plate or the second card clamping plate, and the other end of the another elastic piece is arranged against an inner side of the mounting groove; and the another elastic piece provides an elastic restoring force to the connecting piece to move toward an outer side in the horizontal direction.

Preferably, a blocking device for blocking the cards to fall off is arranged on the first card clamping plate and the second card clamping plate.

Preferably, each blocking device comprises two hinged connecting pieces; one end of each connecting piece is mounted on each of the first card clamping plate and the second card clamping plate; and the other end of each connecting piece is hinged through at least one hinge piece.

Preferably, two connecting devices are arranged on two sides of adjacent sides of the first card clamping plate and the second card clamping plate; and two connecting pieces of each connecting device are indirectly connected through at least one hinge piece.

The technical problem of the present invention is solved through another technical solution shown as follows: a card holder includes a card holder body; the card holder body includes a first card clamping plate, and a second card clamping plate opposite to the first card clamping plate; connecting devices are arranged between the first card clamping plate and the second card clamping plate, and the first card clamping plate and the second card clamping plate are connected with each other through the connecting devices; the connecting devices are arranged on adjacent sides or opposite sides of the first card clamping plate and the second card clamping plate; the connecting devices are opened to occur relative displacement between the first card clamping plate and the second card clamping plate so as to form an internal space being able to stretch out and draw back freely, thus accommodating at least one card; each connecting device includes two connecting pieces being arranged on the first card clamping plate and the second card clamping plate respectively, and the two connecting pieces are directly hinged or indirectly hinged through at least one hinge piece; the card holder body further includes elastic pieces; at an initial position, the elastic pieces have an elastic restoring force through which the first card clamping plate and the second card clamping plate can be mutually clamped and the connecting pieces can be mutually folded; and at an open position, the elastic pieces provide the elastic restoring force through which the first card clamping plate and the second card clamping plate can be restored to the initial position and the connecting pieces can be mutually opened.

Preferably, two connecting devices are arranged on each side of the opposite side edges of the first card clamping plate and the second card clamping plate; or the two connecting devices are arranged on two sides of adjacent sides of the first card clamping plate and the second card clamping plate.

Preferably, the elastic pieces are arranged between two hinge pieces; and the elastic piece are springs or elastic strips or elastic ropes.

Preferably, the elastic pieces are positioned between the first card clamping plate and the second card clamping plate.

Preferably, the elastic pieces are elastic straps or elastic strips.

Preferably, each connecting device further comprises another elastic piece being sleeved the corresponding connecting piece; one end of the another elastic piece is arranged in a mounting groove of the first card clamping plate or the second card clamping plate, and the other end of the another elastic piece is arranged against an inner side of the mounting groove; and the another elastic piece provides the elastic restoring force to the connecting piece to move toward an outer side in the horizontal direction.

Preferably, blocking devices for blocking the cards to fall off are arranged on the first card clamping plate and the second card clamping plate.

Preferably, each blocking device comprises two hinged connecting pieces; one end of each connecting piece is mounted on each of the first card clamping plate and the second card clamping plate; and the other end of each connecting piece is hinged through at least one hinge piece.

Preferably, each connecting device comprises a torsional spring, and two connecting pieces being rotatably connected through a shaft; the torsional spring is sleeved on each connecting piece; a free end of the torsional spring is embedded into the first card clamping plate or the second card clamping plate; the other end of the torsional spring is movably or fixedly connected to the connecting piece; and the torsional spring provides the elastic restoring force to each connecting piece to restore to the initial position.

The present invention has the beneficial effects that:

(1) the structure is simple, the cost is low, a small space is occupied, the use and operation are convenient, and durability is ensured;

(2) through the connecting pieces, elastic displacement is implemented between the first card clamping plate and the second card clamping plate, and the internal space can freely stretch out and draw back to form a clamping restoring pocket that can accommodate the cards; and due to the elastic restoring force of the elastic pieces, the function of accommodating the cards of different sizes and preventing the cards from falling off is achieved.

DETAILED DESCRIPTION OF SOME EMBODIMENTS

The present invention is further described below in conjunction with the accompanying drawings and specific embodiments:

Unless otherwise defined, all technical and scientific terms used herein have the same meaning as those commonly understood by those skilled in the art of the present application; the terms used in the Description of the present application herein are only for the purpose of describing specific embodiments and are not intended to limit the present application; the terms "including" and "having" and any variations thereof in the Description and Claims of the present application and the above-mentioned accompanying drawings are intended to cover non-exclusive inclusions. The terms "first", "second", etc. in the Description and Claims of present application or the above-mentioned accompanying drawings are used for distinguishing different objects, not to describe a specific order.

"Embodiments" herein means that a particular feature, structure, or characteristic described in conjunction with the embodiments may be included in at least one embodiment of the present application. The appearance of the phrase in various locations in the Description does not necessarily refer to the same embodiment, nor is it an independent or alternative embodiment that is mutually exclusive with other embodiments. It is explicitly and implicitly understood by those skilled in the art that the embodiments described herein may be combined with other embodiments.

Figure 1:
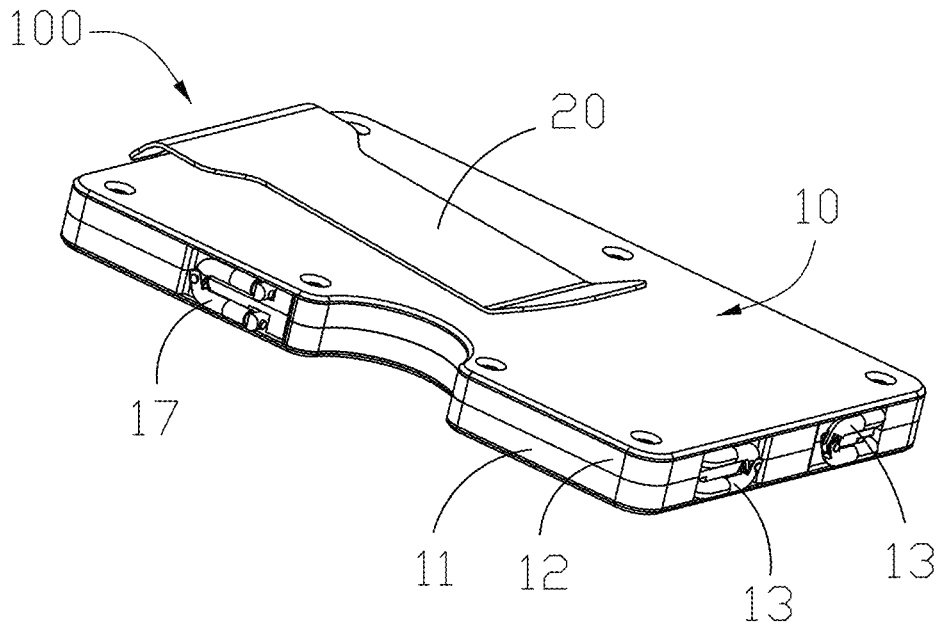
FIG. 1 is a structural schematic diagram of a card holder according to an Embodiment 1 of the present invention.
Figure 2:
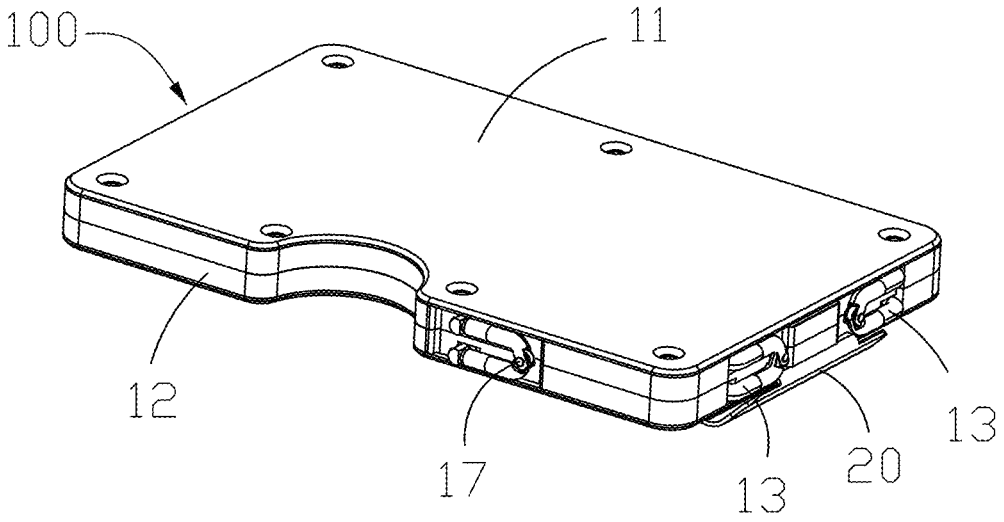
FIG. 2 is another structural schematic diagram of a card holder according to an Embodiment 1 of the present invention.
Figure 3:
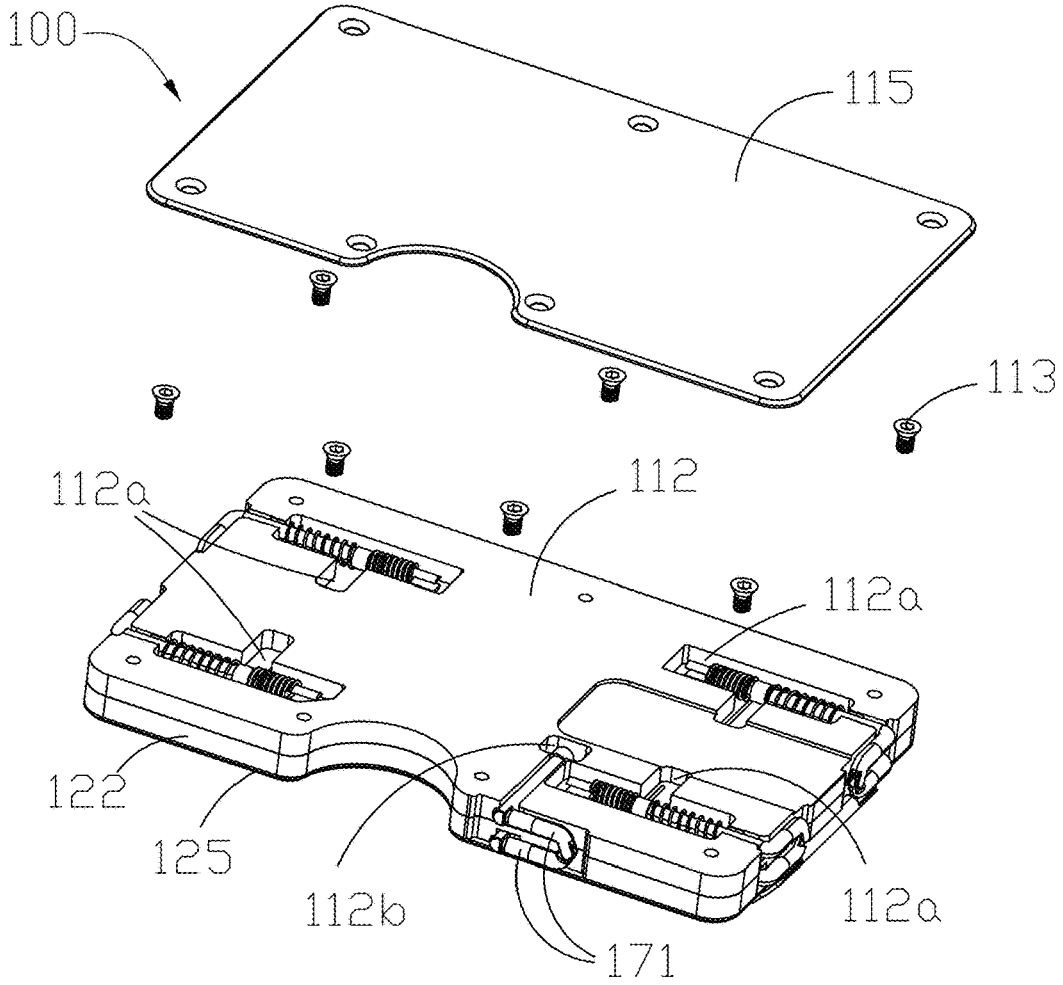
FIG. 3 is a decomposition diagram of a card holder according to an Embodiment 1 of the present invention.

As shown in FIG. 1 to FIG. 3, the present application provides an Embodiment 1 of a card holder. The card holder is a card holder 100 which is simple and convenient to carry a plurality of cards 200. The card holder includes a card holder body 10 and a fixing clamp 20 mounted on the card holder body 10; the fixing clamp 20 is used for fixing the card holder body 10 on a belt or a strap and other objects so as to be convenient to carry or clamp cash. The card holder body 10 includes a first card clamping plate 11, and a second card clamping plate 12 symmetrical to the first card clamping plate 11; the first card clamping plate 11 and the second card clamping plate 12 are connected through four connecting devices 13 with the same structure; elastic pressure is generated between the first card clamping plate 11 and the second card clamping plate 12 in an initial state before use; the first card clamping plate 11 and the second card clamping plate 12 can move in the vertical direction through an external tension; an internal space between the first card clamping plate 11 and the second card clamping plate 12 can be freely expanded to form a pocket 15 (or a space for accommodating a plurality of cards) that can accommodate the cards 200 and has an adjustable space. While releasing the external tension, the first card clamping plate 11 and the second card clamping plate 12 return to initial positions through elastic restoring force, that is, the first card clamping plate 11 and the second card clamping plate 12 are mutually compressed.

By means of the connecting devices 13, elastic displacement is implemented between the first card clamping plate 11 and the second card clamping plate 12 in the vertical direction, the internal space can freely stretch out and draw back to form the pocket 15 that can accommodate the plurality of cards 200, and the function of placing cards of different sizes and different numbers is achieved. Specifically, in this embodiment, two connecting devices 13 are only arranged on opposite side edges between the first card clamping plate 11 and the second card clamping plate 12, and it is to be understood that only one connecting device 13 can be arranged on each side, and three or more connecting devices 13 can also be arranged according to needs and actual conditions. In order to achieve attractiveness, the outermost side ends of the connecting devices 13 are accommodated in a concave space, and the outermost side ends of the connecting devices 13 are flush with the outermost side edges of the first card clamping plate 11 and second card clamping plate 12.

Further, in order to position the plurality of cards 200 and prevent the cards 200 from slipping off, blocking devices 17 for preventing the plurality of cards 200 from slipping off is arranged between the first card clamping plate 11 and the second card clamping plate 12. Each blocking device 17 includes two connecting pieces 171 which can be rotatably connected, and one end of each connecting piece 171 is respectively mounted in each of a mounting groove 112*b* of the first card clamping plate 11 and a mounting groove of the second card clamping plate 12 (not shown, because the first card clamping plate 11 and the second card clamping plate 12 are structurally symmetrical); and the other end of each connecting piece 171 is connected through a rotating shaft. The blocking devices 17 may be not limited to the blocking mode above, and the blocking devices 17 may also be elastic pieces accommodated into grooves in the first card clamping plate 11 and the second card clamping plate 12 or elastic pieces connecting the first card clamping plate 11 and the second card clamping plate 12; and the elastic pieces are any one selected from the group consisting of a telescopic spring, an elastic body, an elastic strap, an elastic belt, a rubber band, an elastic sheet, a corrugated pipe or a spring pipe, in a word, any structures capable of playing a role in blocking is included in the concept of the present application.

As shown in FIG. 3, the first card clamping plate 11 includes a base plate 112 and a mounting plate 115 which is fixed on the base plate 112 through a plurality of fixing pieces 113 (such as screws); and the second card clamping plate 12 includes a base plate 122 and a mounting plate 125 which is fixed on the base plate 122 through a plurality of fixing pieces 113 (such as screws). The outer side surfaces or the inner side surfaces of the first card clamping plate 11 and the second card clamping plate 12 are respectively provided with four mounting grooves 112*a* for accommodating corresponding connecting devices 13.

Figure 4:
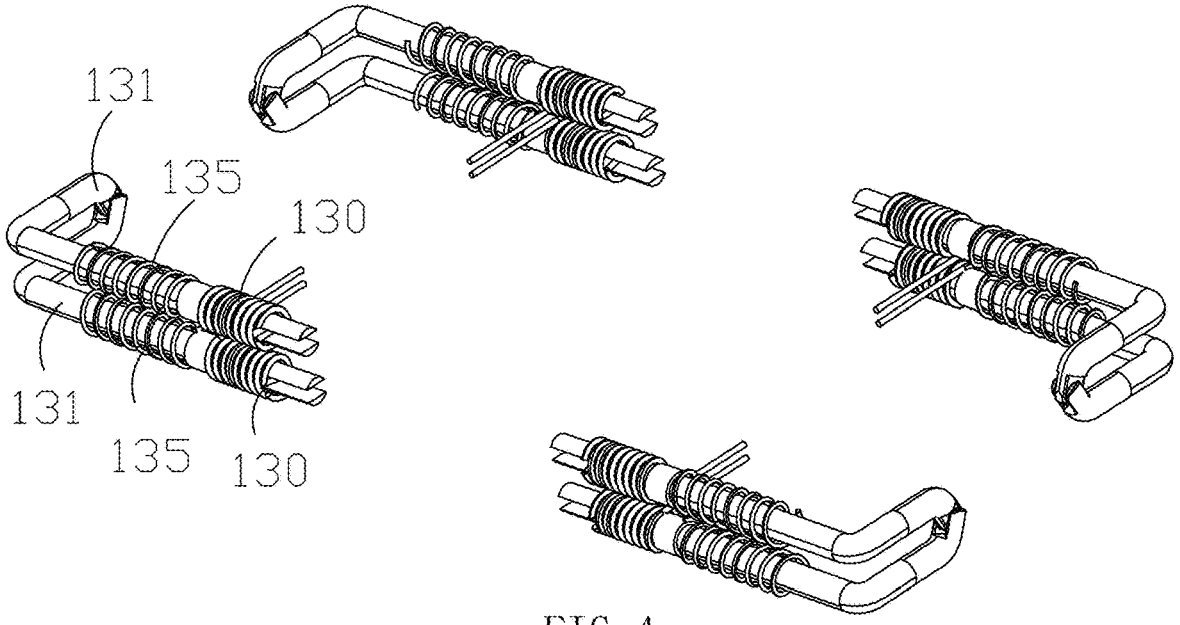
FIG. 4 is a structural schematic diagram of four connecting pieces of a card holder according to an Embodiment 1 of the present invention.
Figure 8:
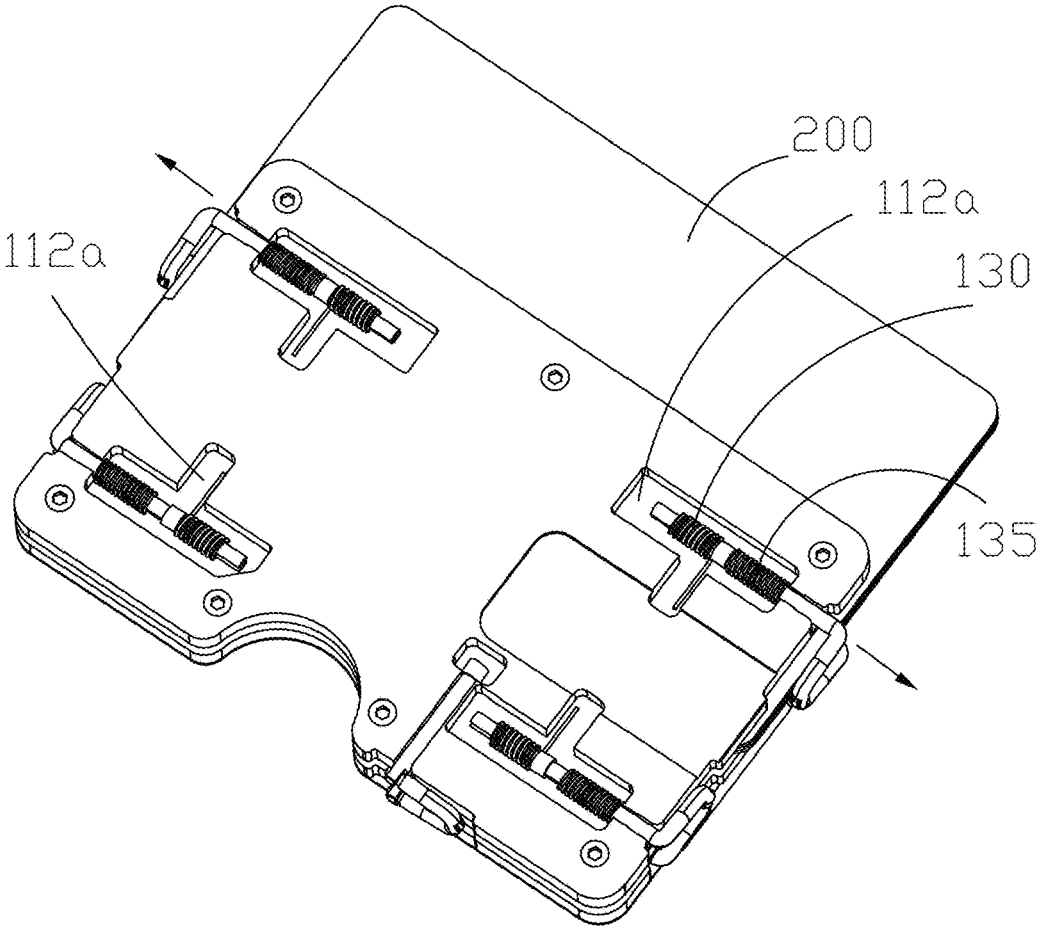
FIG. 8 is a partial structural schematic diagram of a card holder according to an Embodiment 1 of the present invention after few wide cards are placed.

As shown in FIG. 4, each connecting device 13 includes a first elastic piece 130, and two connecting pieces 131 which are rotatably connected through a shaft; the first elastic piece 130 sleeves each connecting piece 131; one free end of the first elastic piece 130 is embedded into the corresponding mounting groove 112*a*, and the other end of the first elastic piece 130 is movably or fixedly connected to the corresponding connecting piece 131; and the first elastic piece 130 provides the elastic restoring force to each connecting piece 131 to restore to the initial position. In this embodiment, the first elastic pieces 130 are torsional springs. In addition, in order to place a card 200 with the width slightly greater than those of the first card clamping plate 11 and the second card clamping plate 12 into the pocket 15, each connecting piece 131 is also sleeved with a second elastic piece 135, the second elastic piece is also accommodated in the mounting groove 112*a*, and one end of the second elastic piece 135 is positioned on the connecting piece 131 while the other end thereof is pressed against the inner side of the corresponding mounting groove 112*a*; when the card 200 with relatively large width is placed into the pocket 15, two ends of the card 200 are pressed against the corresponding connecting piece 131 to make the connecting piece 131 horizontally move towards the outer side (the arrow direction shown in FIG. 8), so that an entering space is provided for the card with the relatively large width; and in addition, when the card with the relatively large width is taken out from the pocket 15, each connecting piece 131 horizontally moves to the initial position from the outer side through the elastic restoring force of the corresponding second elastic piece 135, as shown in FIG. 8. It is to be understood that each connecting piece 131 is subjected to the acting force of the corresponding second elastic piece 135 at the initial position.

Figure 5:
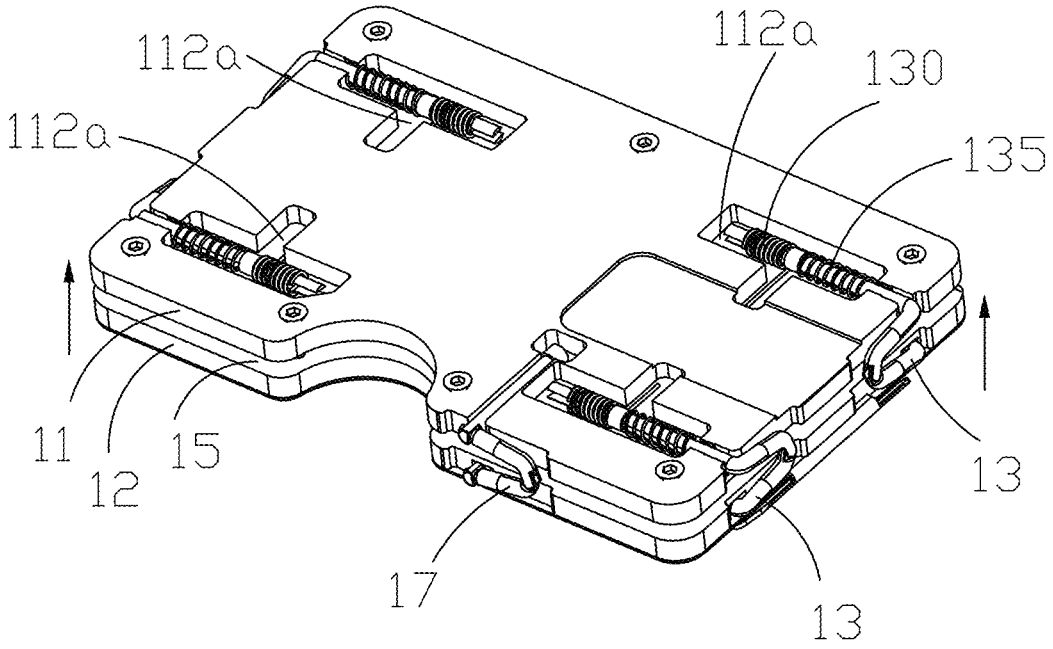
FIG. 5 is a partial structural schematic diagram of a card holder according to an Embodiment 1 of the present invention before few cards are placed.
Figure 6:
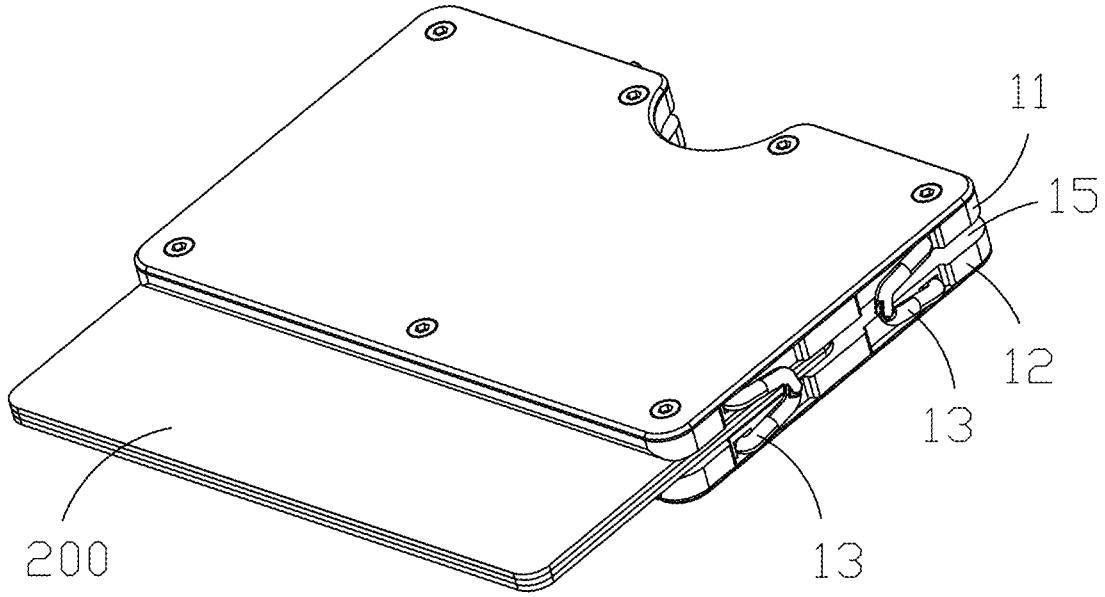
FIG. 6 is a structural schematic diagram of a process of placing few cards of a card holder according to an Embodiment 1 of the present invention.
Figure 7:
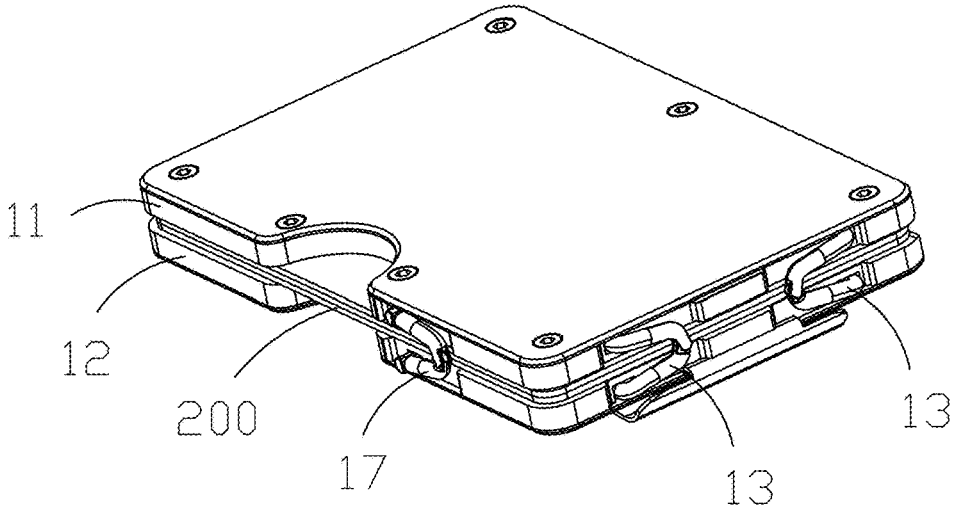
FIG. 7 is a structural schematic diagram of a card holder according to an Embodiment 1 of the present invention after few cards are placed.

As shown in FIG. 5 to FIG. 7, at the initial position, the first card clamping plate 11 and the second card clamping plate 12 of the card holder 100 are pressed against each other through the elastic force of the first elastic pieces 130 (such as the torsion springs), that is, there is a small relative acting force between the first card clamping plate 11 and the second card clamping plate 12. When one or more cards 200 are placed into the card holder 100, the first card clamping plate 11 and the second card clamping plate 12 are relatively displaced in the vertical direction through the external tension (arrow direction shown in FIG. 5), and moreover, two connecting pieces 131 of each connecting device 13 are rotated and opened through a shaft, and two connecting pieces 171 of the blocking devices 17 are rotated and opened through a shaft so as to prevent the cards 200 from being separated; and an accommodating space (or called the pocket 15) for accommodating the cards 200 is formed between the first card clamping plate 11 and the second card clamping plate 12. After the cards 200 are placed, the external tension is released, the first card clamping plate 11 and the second card clamping plate 12 of the card holder 100 are pressed against the cards 200 through the elastic force of the first elastic pieces 130 (such as the torsion springs), and at the moment, there is a large relative acting force (or clamping force) between the first card clamping plate 11 and the second card clamping plate 12, so that the cards 200 can be firmly clamped and prevented from being separated.

Figure 9:
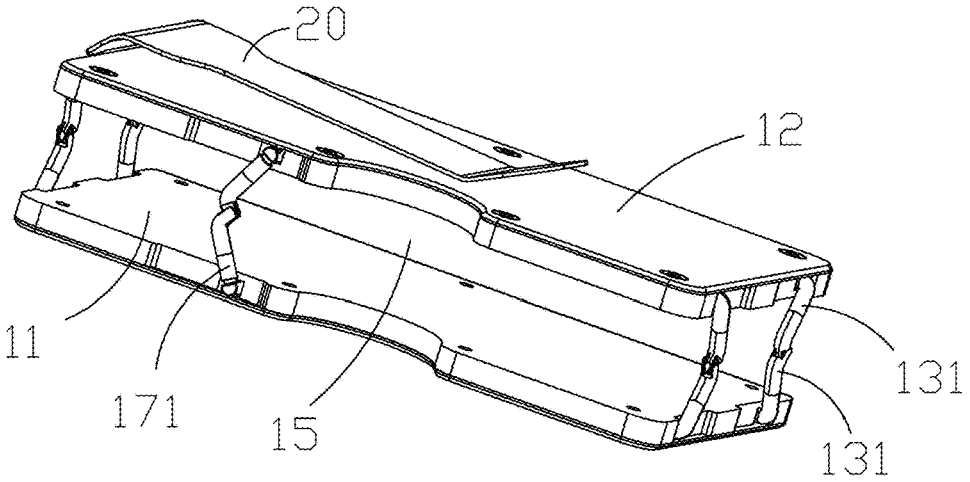
FIG. 9 is a structural schematic diagram of a card holder according to an Embodiment 1 of the present invention before a maximum number of cards are placed.
Figure 10:
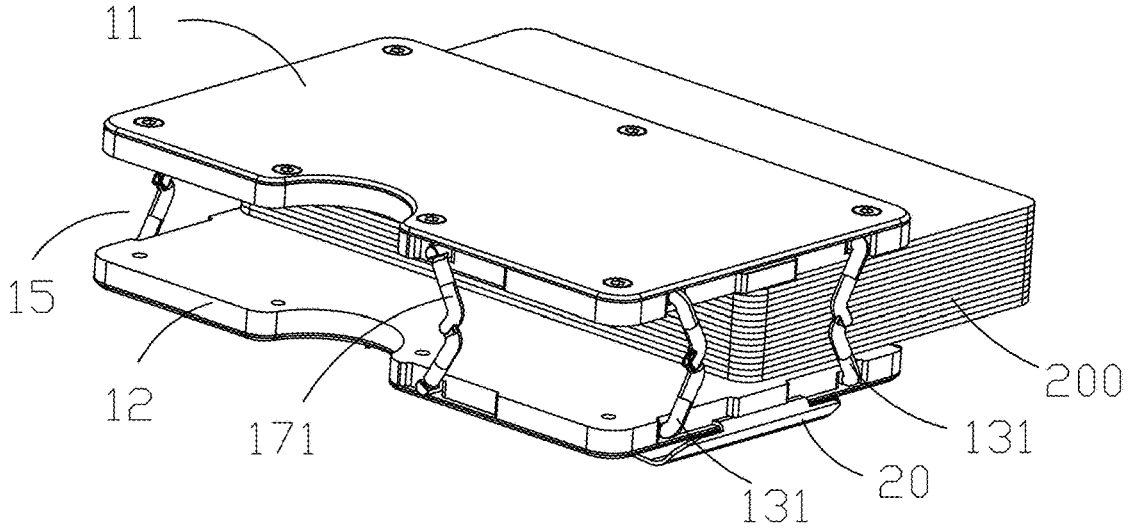
FIG. 10 is a structural schematic diagram of a process of placing a maximum number of cards of a card holder according to an Embodiment 1 of the present invention.
Figure 11:
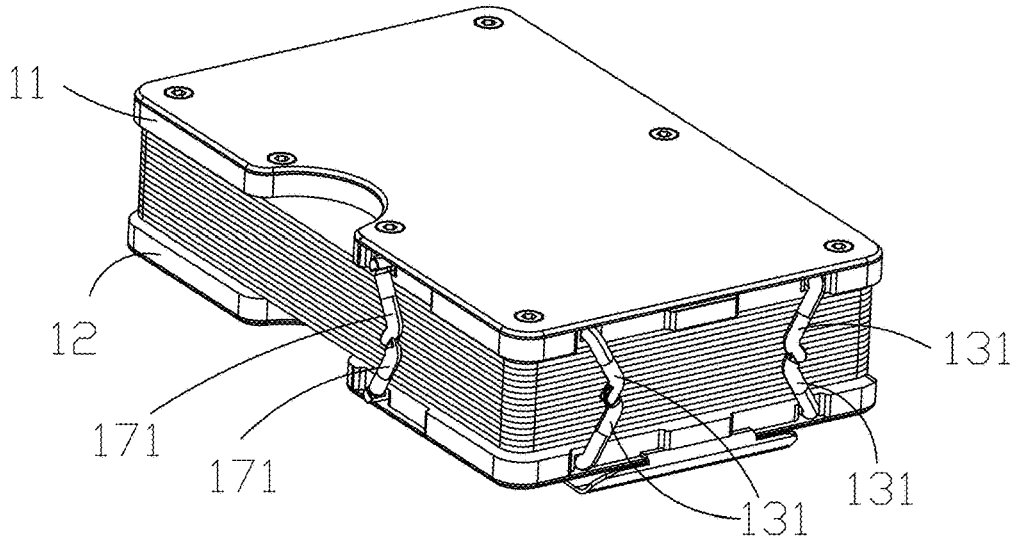
FIG. 11 is a structural schematic diagram of a card holder according to an Embodiment 1 of the present invention after a maximum number of cards are placed.
Figure 12:
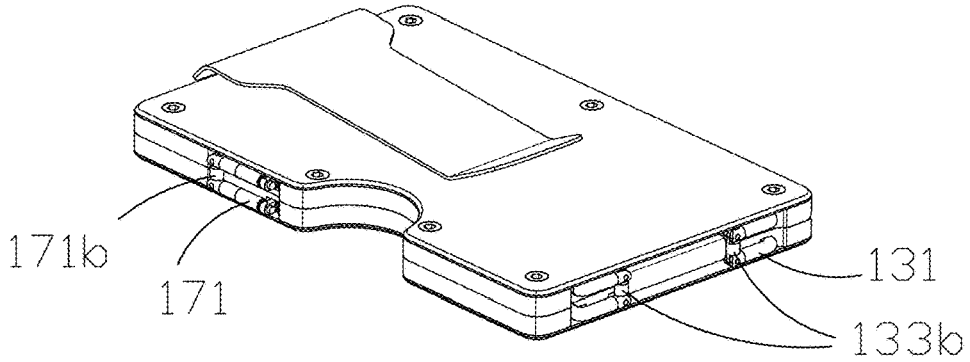
FIG. 12 is a structural schematic diagram of a card holder according to an Embodiment 2 of the present invention.
Figure 13:
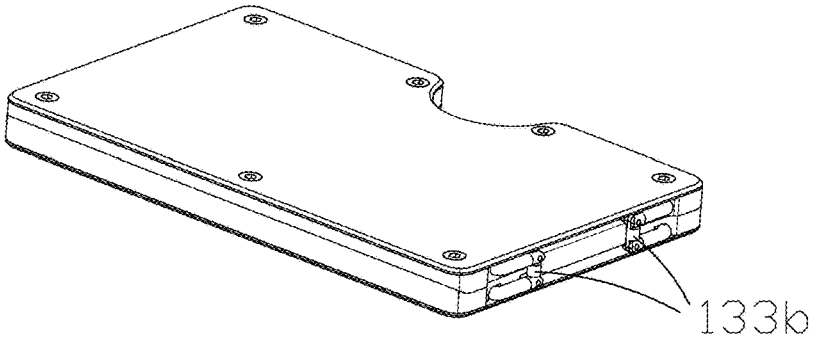
FIG. 13 is another structural schematic diagram of a card holder according to an Embodiment 2 of the present invention.

As shown in FIG. 9 to FIG. 11, FIG. 9 is a structural schematic diagram of a card holder 100 before a maximum number of cards 200 are placed. As shown in FIG. 9, the distance between the first card clamping plate 11 and the second card clamping plate 12 is the largest, namely, in this state, the two connecting pieces 131 of each connecting device 13 are opened by the largest angle, and the two connecting pieces 171 of the blocking devices 17 are also opened by the largest angle. Moreover, the elastic restoring force of the first elastic pieces 130 (such as the torsional springs) on the first card clamping plate 11 and the second card clamping plate 12 of the card holder 100 is also the largest, namely, the relative acting force between the first card clamping plate 11 and the second card clamping plate 12 is also the largest (the clamping force is the largest). Therefore, the maximum number of cards 200 are firmly clamped between the first card clamping plate 11 and the second card clamping plate 12 and are not prone to falling off.

According to the present invention, by means of the connecting devices 13, the first elastic pieces 130 drive the connecting pieces 131 to drive the first card clamping plate 11 and the second card clamping plate 12 to implement vertical elastic displacement, thus the cards accommodated in the internal space between the first card clamping plate 11 and the second card clamping plate 12 can be clamped, and a user can take out and place the cards conveniently, and the operation is simple and convenient; because the blocking devices 17 are arranged, the cards 200 are prevented from falling off from the pocket 15; and therefore, the card holder can be prevented from falling off; the structure is simple; and use is convenient.

Figure 14:
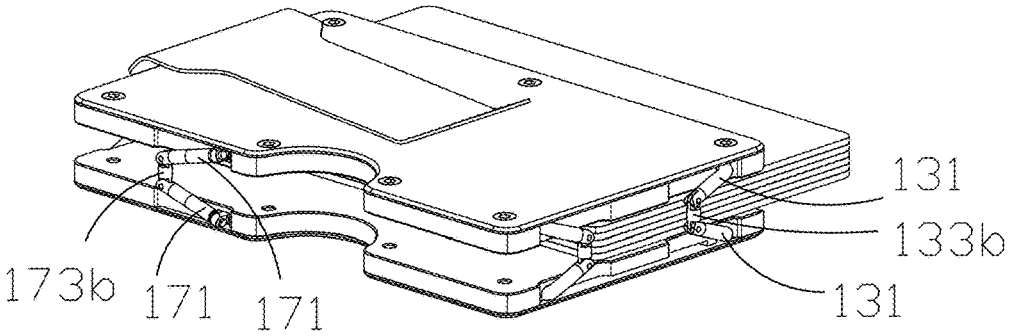
FIG. 14 is a structural schematic diagram of a process of placing a part of cards of a card holder according to an Embodiment 2 of the present invention.
Figure 15:
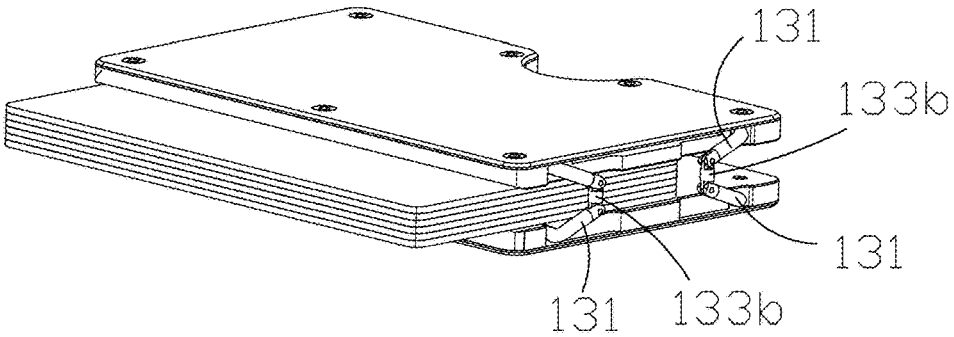
FIG. 15 is another structural schematic diagram of a process of placing a part of cards of a card holder according to an Embodiment 2 of the present invention.
Figure 16:
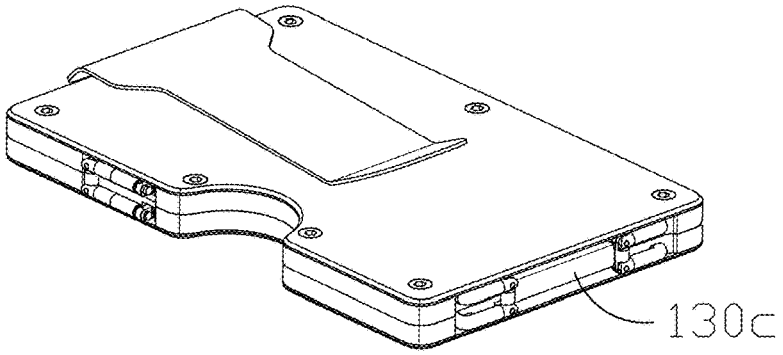
FIG. 16 is a structural schematic diagram of a card holder according to an Embodiment 3 of the present invention.
Figure 17:
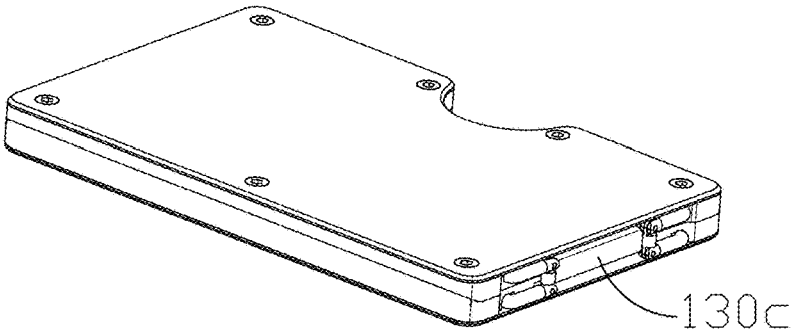
FIG. 17 is another structural schematic diagram of a card holder according to an Embodiment 3 of the present invention.

As shown in FIG. 12 to FIG. 15, FIG. 12 and FIG. 13 show structure schematic diagrams of a card holder according to an Embodiment 2 of the present invention, and FIG. 14 and FIG. 15 show structure schematic diagrams of a process of placing a plurality of cards of a card holder according to an Embodiment 2 of the present invention. The structure of the card holder according to the Embodiment 2 is basically the same as that of the card holder according to the Embodiment 1, and the main difference is that: the two connecting pieces 131 of the connecting devices 13 are not directly hinged together, but are indirectly hinged together through an hinge piece 133*b*. The two connecting pieces 171 of the blocking devices 17 are not directly hinged together, but are indirectly hinged together through an hinge piece 173*b*. It is to be understood that the number of the hinge pieces 133*b* can be two, three and the like. The number of the hinge pieces 173*b* can be two, three and the like. The number of the hinge pieces 173*b* can also be zero, that is, the two connecting pieces 171 are directly hinged, but are not indirectly hinged.

Figure 18:
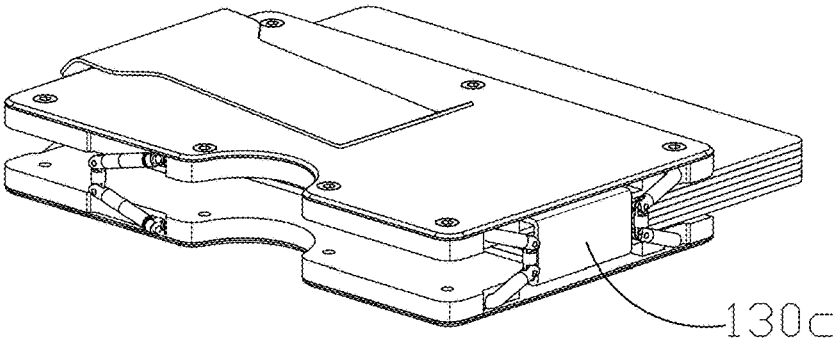
FIG. 18 is a structural schematic diagram of a process of placing a part of cards of a card holder according to an Embodiment 3 of the present invention.
Figure 19:
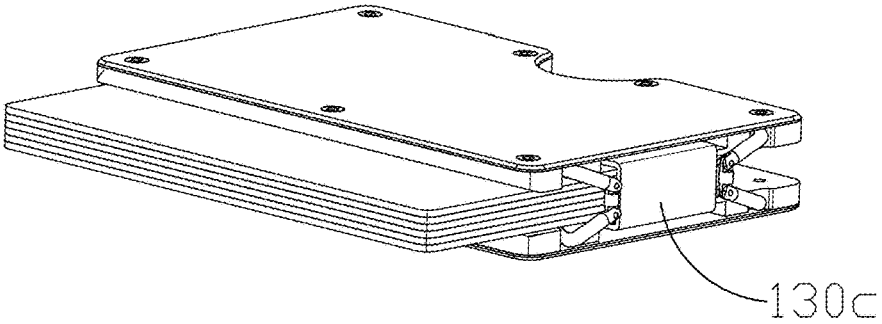
FIG. 19 is another structural schematic diagram of a process of placing a part of cards of a card holder according to an Embodiment 3 of the present invention.
Figure 20:
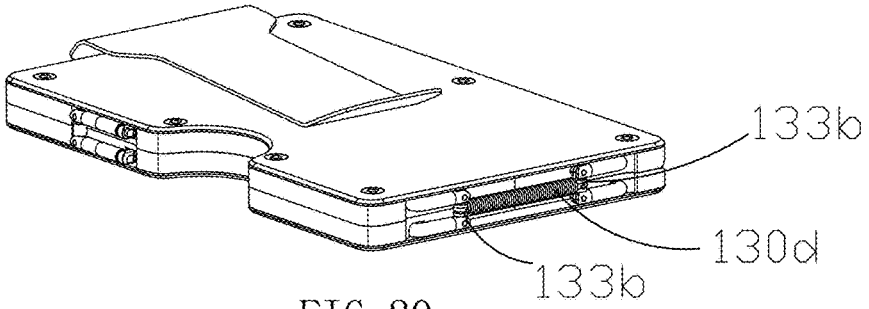
FIG. 20 is a structural schematic diagram of a card holder according to an Embodiment 4 of the present invention.
Figure 21:
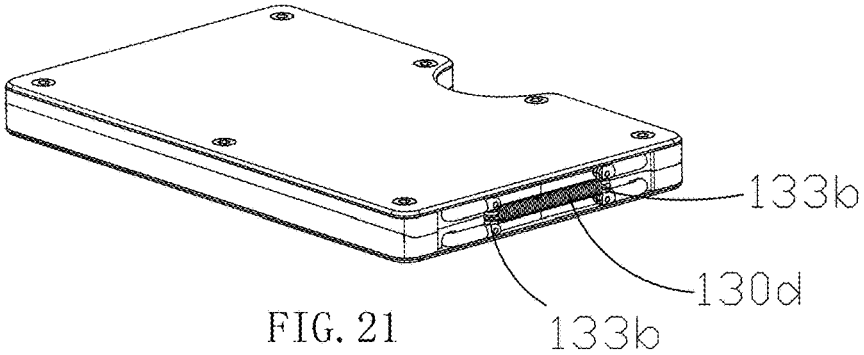
FIG. 21 is another structural schematic diagram of a card holder according to an Embodiment 4 of the present invention.

As shown in FIG. 16 to FIG. 19, FIG. 16 and FIG. 17 show structure schematic diagrams of a card holder according to an Embodiment 3 of the present invention, and FIG. 18 and FIG. 19 show structure schematic diagrams of a processing of placing a plurality of cards of a card holder according to an Embodiment 3 of the present invention. The structure of the card holder according to the Embodiment 3 is basically the same as that of the card holder according to the Embodiment 2, and the main difference is that: the first elastic piece 130 sleeving each connecting piece 131 is removed, an elastic strap 130*c* (or an elastic strip, an elastic rope and other elastic piece) is arranged at each of two ends between the first card clamping plate 11 and the second card clamping plate 12, and the first card clamping plate 11 and the second card clamping plate 12 are restored to the initial position from the open position through the elastic restoring force of the two opposite elastic straps 130*c*. It is to be understood that the arrangement of the elastic straps 130*c* can also be applied to the card holder according to the Embodiment 1, and the first elastic piece 130 sleeving each connecting piece 131 can be arranged or not arranged. From the perspective of saving cost, the first elastic piece 130 sleeving each connecting piece 131 is not arranged generally.

Figure 22:
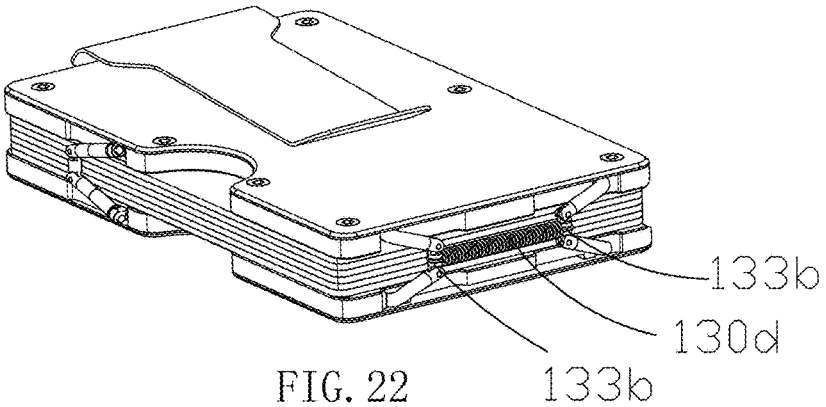
FIG. 22 is a structural schematic diagram of a process of placing a part of cards of a card holder according to an Embodiment 4 of the present invention.
Figure 23:
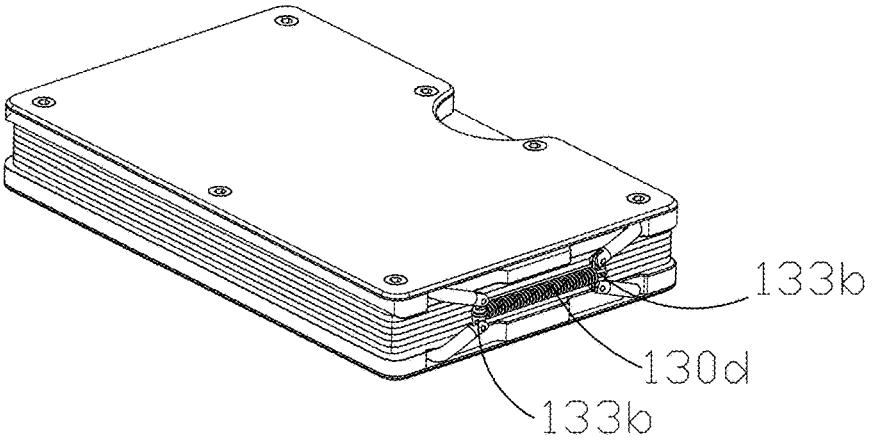
FIG. 23 is another structural schematic diagram of a process of placing a part of cards of a card holder according to an Embodiment 4 of the present invention.

As shown in FIG. 20 to FIG. 23, FIG. 20 and FIG. 21 are structural schematic diagrams of a card holder according to an Embodiment 4 of the present invention, and FIG. 22 and FIG. 23 are structural schematic diagrams of a process of inserting a plurality of cards of a card holder according to an Embodiment 4 of the present invention. The structure of the card holder according to the Embodiment 4 is basically the same as that of the card holder according to the Embodiment 2, and the main difference is that: the first elastic piece 130 sleeving each connecting piece 131 is removed, springs 130*d* (or an elastic strip, an elastic strap or an elastic rope and other elastic pieces) are connected to two ends of the first card clamping plate 11 and the second card clamping plate 12 and between two hinge pieces 133*b*, and the first card clamping plate 11 and the second card clamping plate 12 are restored to the initial position from the open position through elastic restoring force of the springs 130*d*. It is to be understood that the arrangement of the springs 130*d* can also be applied to the card holder according to the Embodiment 1, and the first elastic piece 130 sleeving each connecting piece 131 can be arranged or not arranged. From the perspective of saving cost, the first elastic piece 130 sleeving each connecting piece 131 is not arranged generally.

Figure 24:
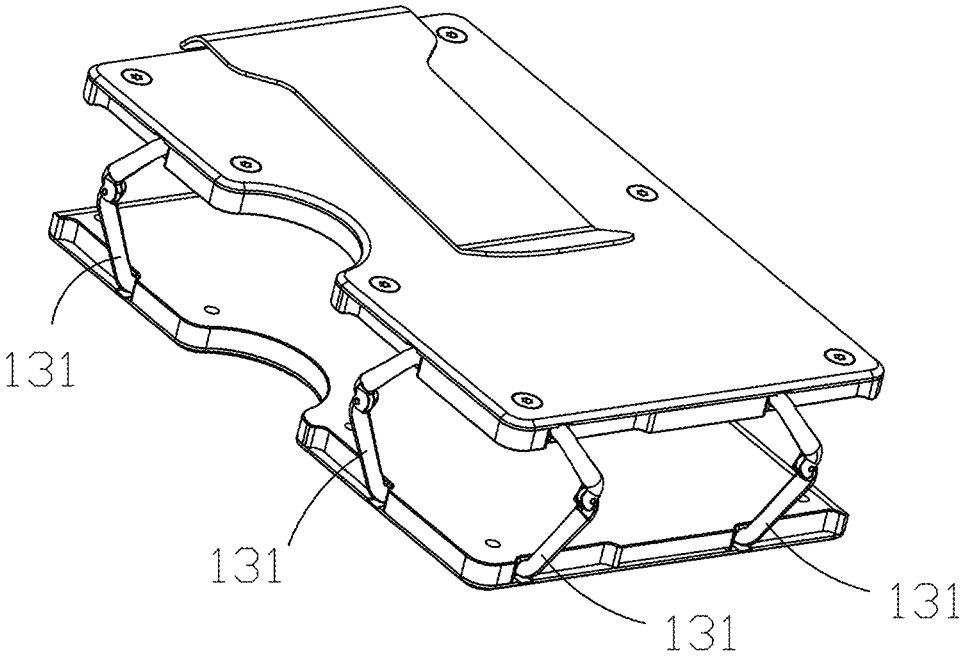
FIG. 24 is a structural schematic diagram of a card holder according to an Embodiment 5 of the present invention.
Figure 25:
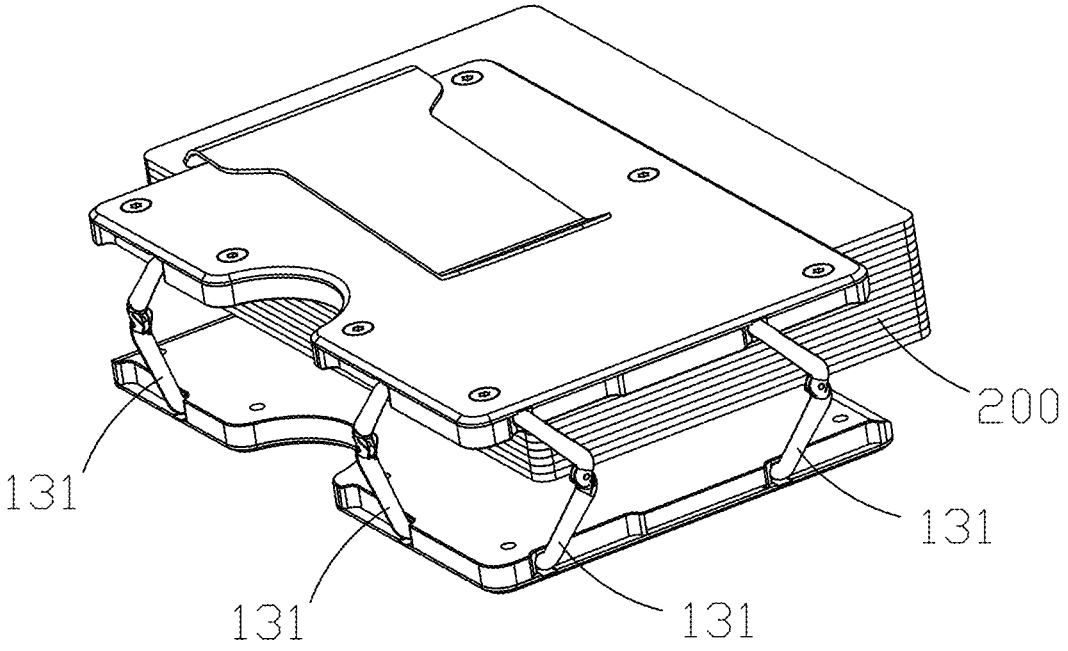
FIG. 25 is structural schematic diagram of a process of placing cards of a card holder according to an Embodiment 5 of the present invention.

As shown in FIG. 24 and FIG. 25, the structure of card holder according to an Embodiment 5 is similar to that of the card holder according to the Embodiment 1, and the main difference is that: the arrangement position of the connecting devices 13 is different from that in the Embodiment 1, and the blocking devices 17 are removed. Specifically, two adjacent side edges of the card holder are respectively provided with two connecting devices 13, and the other two side edges are not provided with the connecting devices 13, so that the card 200 can be conveniently placed into the card holder or the card 200 can be conveniently pushed out of the card holder with fingers.

Figure 26:
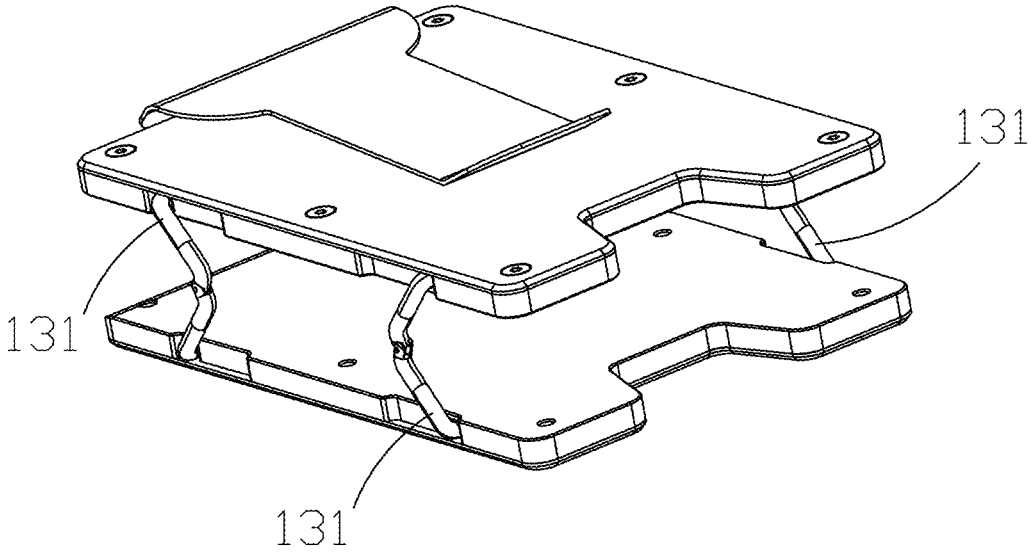
FIG. 26 is a structural schematic diagram of a card holder according to an Embodiment 6 of the present invention.
Figure 27:
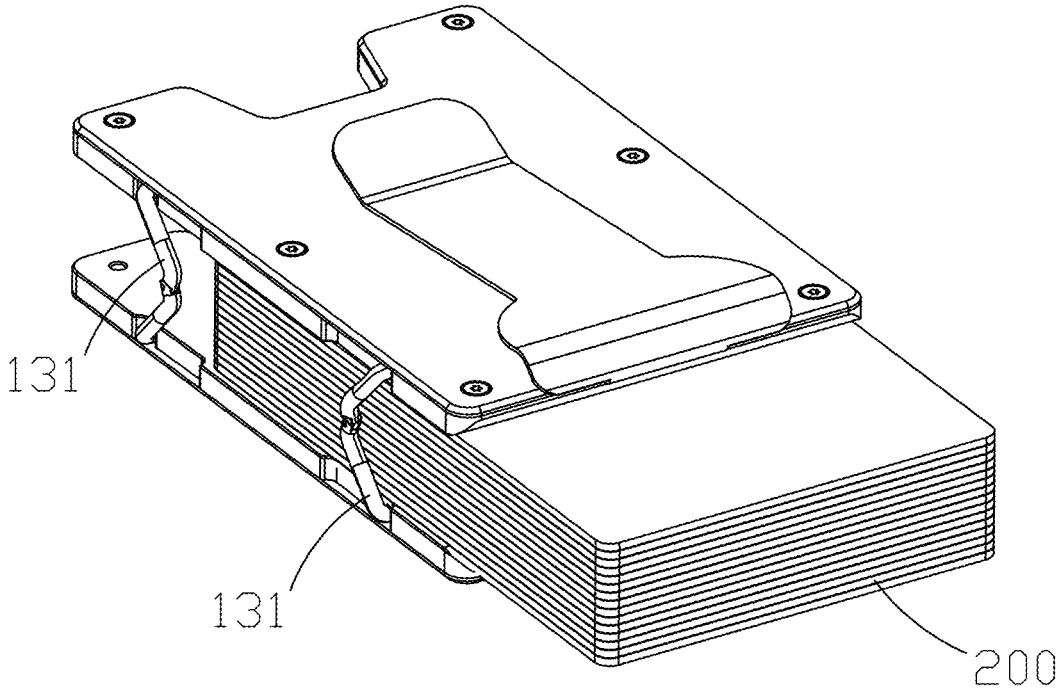
FIG. 27 is structural schematic diagram of a process of placing cards of a card holder according to an Embodiment 6 of the present invention.

As shown in FIG. 26 and FIG. 27, the structure of the card holder according to an Embodiment 6 is similar to that of the card holder according to the Embodiment 1, and the main difference is that: the arrangement position of the connecting device 13 is different from that of the Embodiment 1, and the blocking devices 17 are removed. Specifically, two opposite side edges of the card holder are respectively provided with two connecting devices 13, and the other two opposite side edges are not provided with the connecting devices 13, so that the card 200 can be conveniently inserted into the card holder or the card 200 can be conveniently pushed out of the card holder with fingers.

It is to be understood that if two connecting pieces 131 are directly hinged or indirectly hinged through at least one hinge piece, and there is enough friction force between the two connecting pieces 131, the elastic pieces for restoring the first card clamping plate 11 and the second card clamping plate 12 from the open position to the initial position can also be removed. Due to the friction force or resistance, the first card clamping plate 11 and the second card clamping plate 12 can be slightly pulled to be opened; and the first card clamping plate 11 and the second card clamping plate 12 can be slightly pressed to clamp the plurality of cards 200, thus preventing the cards 200 from falling off.

According to the present invention, by means of the connecting devices 13, the first card clamping plate 11 and the second card clamping plate 12 are driven to implement the vertical elastic displacement, so that the accommodate space is formed between the first card clamping plate 11 and the second card clamping plate 12 to accommodate the plurality of cards; the first elastic pieces are arranged to provide the elastic restoring force through which the first card clamping plate 11 and the second card clamping plate 12 can clamp the plurality of cards, thus the user can conveniently take out and place the cards, and the operation is simple and convenient; and because the blocking devices 17 are arranged, the cards 200 can be prevented from falling out of the pocket 15; and therefore, the card holder can be prevented from falling off; the structure is simple; and use is convenient.

According to the disclosure and teaching of the above Description, those skilled in the art of the present invention can also make appropriate changes and modifications to the above implementation. Therefore, the present invention is not limited to the specific implementation methods disclosed and described above, and some modifications and changes to the present invention should also fall within the scope of protection of the Claims of the present invention. In addition, although some specific terms are used in the Description, these terms are only for the convenience of description and do not constitute any limitation to the present invention.

What is claimed is:

1. A card holder, comprising a card holder body, wherein the card holder body comprises a first card clamping plate and a second card clamping plate; at least one connecting device is arranged between the first card clamping plate and the second card clamping plate, and the first card clamping plate and the second card clamping plate are connected through the at least one connecting device; each connecting device comprises two connecting pieces being directly or indirectly hinged; the connecting pieces are opened so that the first card clamping plate and the second card clamping plate move relatively, thus forming an internal variable space to accommodate a plurality of cards; the card holder body further comprises elastic pieces arranged on the card holder body, and the elastic pieces provide an elastic restoring force to the first card clamping plate and the second card clamping plate to restore from an open position to an initial position; and the elastic pieces have the elastic restoring force at the initial position so that the first card clamping plate and the second card clamping plate are mutually clamped and the connecting pieces are mutually folded.

2. The card holder according to claim 1, wherein two connecting devices are arranged on each side of the opposite sides of the first card clamping plate and the second card clamping plate; and the two connecting pieces of each connecting device are indirectly hinged through at least one hinge piece.

3. The card holder according to claim 2, wherein the elastic pieces are arranged between two hinge pieces; and the elastic pieces are springs or elastic strips or elastic ropes.

4. The card holder according to claim 1, wherein the elastic pieces are positioned between the first card clamping plate and the second card clamping plate.

5. The card holder according to claim 4, wherein the elastic pieces are elastic straps or elastic strips.

6. The card holder according to claim 1, wherein each connecting device further comprises another elastic piece being sleeved the corresponding connecting piece; one end of the another elastic piece is arranged in a mounting groove of the first card clamping plate or the second card clamping plate, and the other end of the another elastic piece is arranged against an inner side of the mounting groove; and the another elastic piece provides an elastic restoring force to the connecting piece to move toward an outer side in the horizontal direction.

7. The card holder according to claim 1, wherein a blocking device for blocking the cards to fall off is arranged on the first card clamping plate and the second card clamping plate.

8. The card holder according to claim 7, wherein each blocking device comprises two hinged connecting pieces; one end of each connecting piece is mounted on each of the first card clamping plate and the second card clamping plate; and the other end of each connecting piece is hinged through at least one hinge piece.

9. The card holder according to claim 1, wherein two connecting devices are arranged on two sides of adjacent sides of the first card clamping plate and the second card clamping plate; and two connecting pieces of each connecting device are indirectly connected through at least one hinge piece.

10. A card holder, comprising a card holder body, wherein the card holder body comprises a first card clamping plate, and a second card clamping plate opposite to the first card clamping plate; connecting devices are arranged between the first card clamping plate and the second card clamping plate, and the first card clamping plate and the second card clamping plate are connected with each other through the connecting devices; the connecting devices are arranged on adjacent sides or opposite sides of the first card clamping plate and the second card clamping plate; the connecting devices are opened to occur relative displacement between the first card clamping plate and the second card clamping plate so as to form an internal space being able to stretch out and draw back freely, thus accommodating at least one card; each connecting device comprises two connecting pieces being arranged on the first card clamping plate and the second card clamping plate respectively, and the two connecting pieces are directly hinged or indirectly hinged through at least one hinge piece; the card holder body further comprises elastic pieces; at an initial position, the elastic pieces have an elastic restoring force through which the first card clamping plate and the second card clamping plate are mutually clamped and the connecting pieces are mutually folded; and at an open position, the elastic pieces provide the elastic restoring force through which the first card clamping plate and the second card clamping plate are restored to the initial position and the connecting pieces are mutually opened.

11. The card holder according to claim 10, wherein two connecting devices are arranged on each side of the opposite side edges of the first card clamping plate and the second card clamping plate; or the two connecting devices are arranged on two sides of adjacent sides of the first card clamping plate and the second card clamping plate.

12. The card holder according to claim 11, wherein the elastic pieces are arranged between two hinge pieces; and the elastic piece are springs or elastic strips or elastic ropes.

13. The card holder according to claim 10, wherein the elastic pieces are positioned between the first card clamping plate and the second card clamping plate.

14. The card holder according to claim 13, wherein the elastic pieces are elastic straps or elastic strips.

15. The card holder according to claim 10, wherein each connecting device further comprises another elastic piece being sleeved on the corresponding connecting piece; one end of the another elastic piece is arranged in a mounting groove of the first card clamping plate or the second card clamping plate, and the other end of the another elastic piece is arranged against an inner side of the mounting groove; and the another elastic piece provides the elastic restoring force to the connecting piece to move toward an outer side in the horizontal direction.

16. The card holder according to claim 10, wherein blocking devices for blocking the cards to fall off are arranged on the first card clamping plate and the second card clamping plate.

17. The card holder according to claim 16, wherein each blocking device comprises two hinged connecting pieces; one end of each connecting piece is mounted on each of the first card clamping plate and the second card clamping plate; and the other end of each connecting piece is hinged through at least one hinge piece.

18. The card holder according to claim 10, wherein each connecting device comprises a torsional spring, and two connecting pieces being rotatably connected through a shaft; the torsional spring is sleeved on each connecting piece; a free end of the torsional spring is embedded into the first card clamping plate or the second card clamping plate; the other end of the torsional spring is movably or fixedly connected to the connecting piece; and the torsional spring provides the elastic restoring force to each connecting piece to restore to the initial position.

* * * * *